US006411265B1

(12) United States Patent
Tsai et al.

(10) Patent No.: US 6,411,265 B1
(45) Date of Patent: Jun. 25, 2002

(54) ANTENNA ADAPTER

(75) Inventors: Hui Tze Tsai, Chung-Hua (TW); Ryan Yeh, Chino Hills, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/540,059

(22) Filed: Mar. 31, 2000

(51) Int. Cl.[7] ..... H01Q 1/24; H01Q 1/50
(52) U.S. Cl. ..... 343/906; 343/702
(58) Field of Search ..... 343/702, 906, 343/878; 455/90; 439/916; H01Q 1/24, 1/50

(56) References Cited

U.S. PATENT DOCUMENTS 5,949,379 A * 9/1999 Yang ..... 343/702
6,091,368 A * 7/2000 Mitchell et al. ..... 343/702
6,157,350 A * 12/2000 House et al. ..... 343/906
6,191,741 B1 * 2/2001 Gauld et al. ..... 343/702

* cited by examiner

*Primary Examiner*—Hoanganh Le
(74) *Attorney, Agent, or Firm*—Wei Te Chung

(57) ABSTRACT

An antenna adapter in accordance with the present invention comprises an elongate housing defining a receiving space and first and second ends opposite to each other. A first connector is fixedly positioned in the first end. A second connector is rotationally arranged in the second end and is electrically coupled to the first connector. A positioning device is arranged between the housing and the second connector such that the second connector can be angularly positioned with respect to the housing.

6 Claims, 7 Drawing Sheets

ANTENNA ADAPTER

FIELD OF THE INVENTION

The present invention relates to an adapter, and more particularly, to an antenna adapter used between an electrical connector and an antenna.

DESCRIPTION OF THE PRIOR ART

Wireless devices using RF (radio frequency) become more and more popular in the personal computer industry. For example, a PCMCIA card is provided with a RF antenna which is configured by a pair of wires. However, for the best working performance, it is better to keep the antenna in a vertical position which gives best emitting and receiving performance. Nevertheless, it is unlikely to erect those pair of wires without any fixture thereof. In addition, the PCMCIA card is inserted into a card edge connector, and it is not feasible to attach a wire fixture to the card.

In addition, mounting position of a connection in a panel can not ensure the attached antenna to be kept in a vertical position. There is a need to provide a device such that the attached antenna will be kept or capable of being adjusted in a vertical position.

SUMMARY OF THE INVENTION

An object of the present invention is to provide an antenna adapter such that an attached antenna can be always kept in a vertical position.

In order to achieve to the above mentioned object, an antenna adapter in accordance with the present invention comprises an elongate housing defining a receiving space and first and second ends opposite to each other. A first connector is fixedly positioned in the first end. A second connector is rotationally positioned in the second end and is electrically coupled to the first connector. A positioning device is arranged between the housing and the second connector such that the second connector can be angularly positioned with respect to the housing. The positioning device includes a cylindrical body defining a chamber therein. A bottom of the body defines a hole thereof. The cylindrical body further includes a cam periphery atop thereof. The second connector includes a tubular body rotationally received in the chamber of the positioning device means. The tubular body further includes a shaft extending through the hole of the cylindrical body and a post anchoring the second connector respect to the cam periphery of the cylindrical body.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
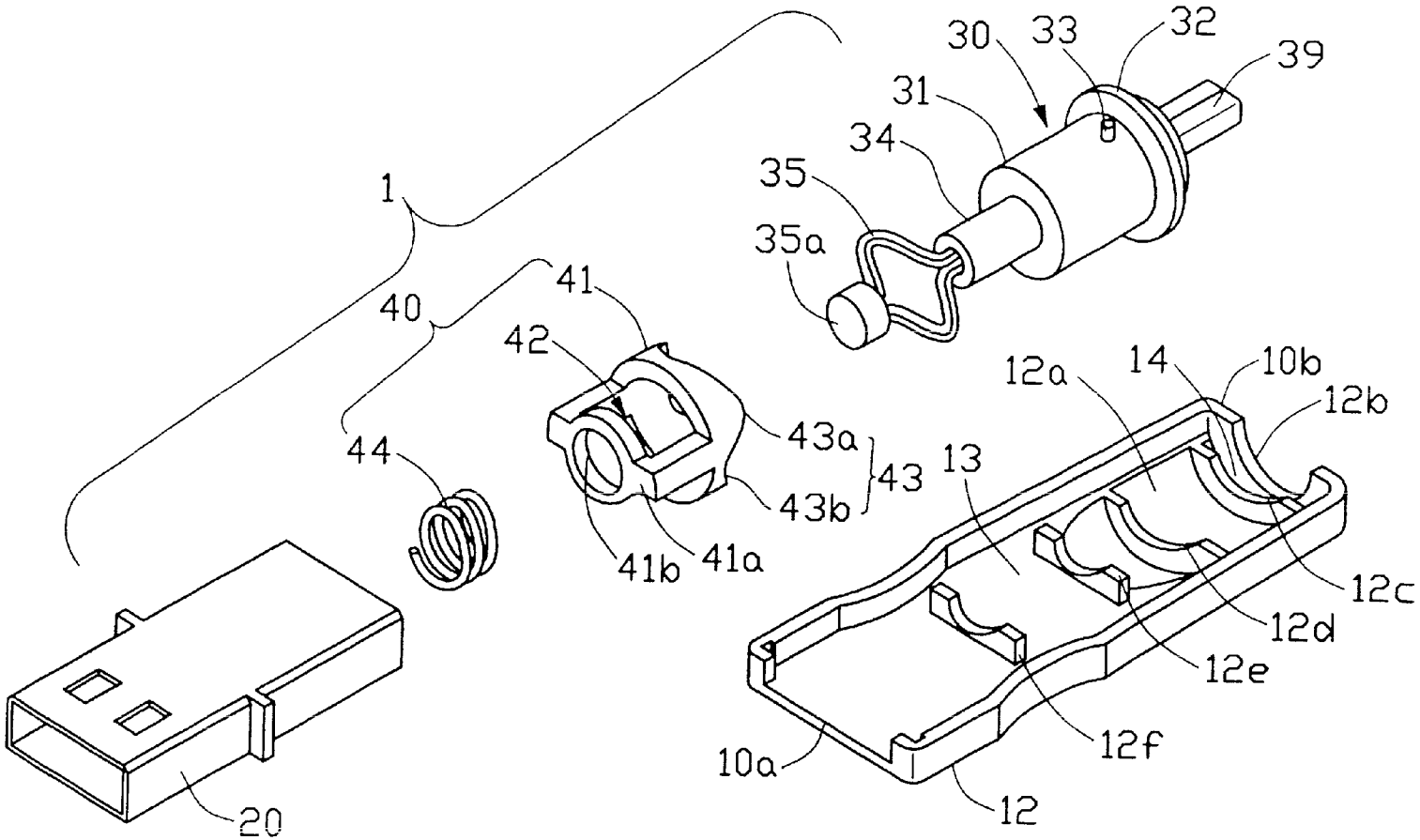
FIG. 1 is an exploded view of an antenna adapter in accordance with the present invention.

Referring to FIGS. 1 to 5, an antenna adapter 1 in accordance with the present invention comprises an elongate housing 10 which is configured by upper and lower halves 11, 12. The housing 10 defines a lengthwise direction thereof with a receiving space 13 therein and first and second ends 10*a*, 10*b* opposite to each other. The upper and lower halves 11, 12 have the same configuration and only the lower half 12 is shown in FIG. 1. The lower half 12 includes a circular recessed portion 12*a* and a plurality of ribs 12*b*, 12*c*, 12*d*, 12*e* and 12*f*. The rib 12*b* is formed on the second end 10*b* and a slot 14 is defined between ribs 12*b* and 12*c*. As mentioned above, the lower half 12 is identical to the upper half 11, accordingly, the upper half 11 has also a slot (not shown) cooperating with the slot 14, i.e. the slots will jointly define a circular slot along the inner wall of the upper and lower halves 11, 12.

A first connector 20 is fixedly positioned in the first end 10*b*. In the preferred embodiment, the first connector 20 is a USB connector. A second connector 30 is rotationally positioned in the circular recessed portion 12*a* close to the second end 10*b*. The second connector 30 includes a tubular body 31 with a ring 32 formed thereof and which is rotationally received in the slot 14 formed in the lower half 12 and the slot in the upper half 11. By this arrangement, the tubular body 31 will not escape from the housing 10, while is rotationally arranged within the housing 10. The tubular body 31 further includes a post 33. A shaft 34 extends from a bottom of the body 31 and with cable 35 integrally molded therein. The cable 35 are split and form a loop for facilitating rotation of the second connector 30. The loop will provide a buffer for rotation of the cable 35 without damaging connections with the first connector 20. Ends 35*a* of the cable 35 are electrically connected or soldered to the first connector 20.

The cable 35 includes four wires which are designated for two signals, one ground and one power and each is connected to corresponding terminals of the first connector 20 (not shown).

A positioning device 40 is arranged between the housing 10 and the second connector 30 such that the second connector 30 can be angularly positioned with respect to the housing 10. The positioning device 40 includes a cylindrical body 41 defining a chamber 42 therein. A bottom 41*a* of the cylindrical body 41 defines a hole 41*b* therein. The chamber 42 and the hole 41*b* are dimensioned such that the tubular body 31 can be rotationally disposed in the chamber 42 while the shaft 34 can extend through the hole 41*b*. The cylindrical body 41 further includes a cam periphery 43 atop thereof and which includes peaks 43*a* and valleys 43*b*. When the tubular body 31 of the second connector 30 is rotationally inserted into the chamber 42 of the positioning device 40, the post 33 abuts against the cam periphery 43. In order to keep the post 33 in constant contact with the cam periphery 43, a spring 44 is enveloped on the shaft 34 and which is bridged between the rib 12*f* and the bottom 41*a*. By this arrangement, the spring force will constantly push the positioning device 40 against the second connector 30.

Figure 1A:
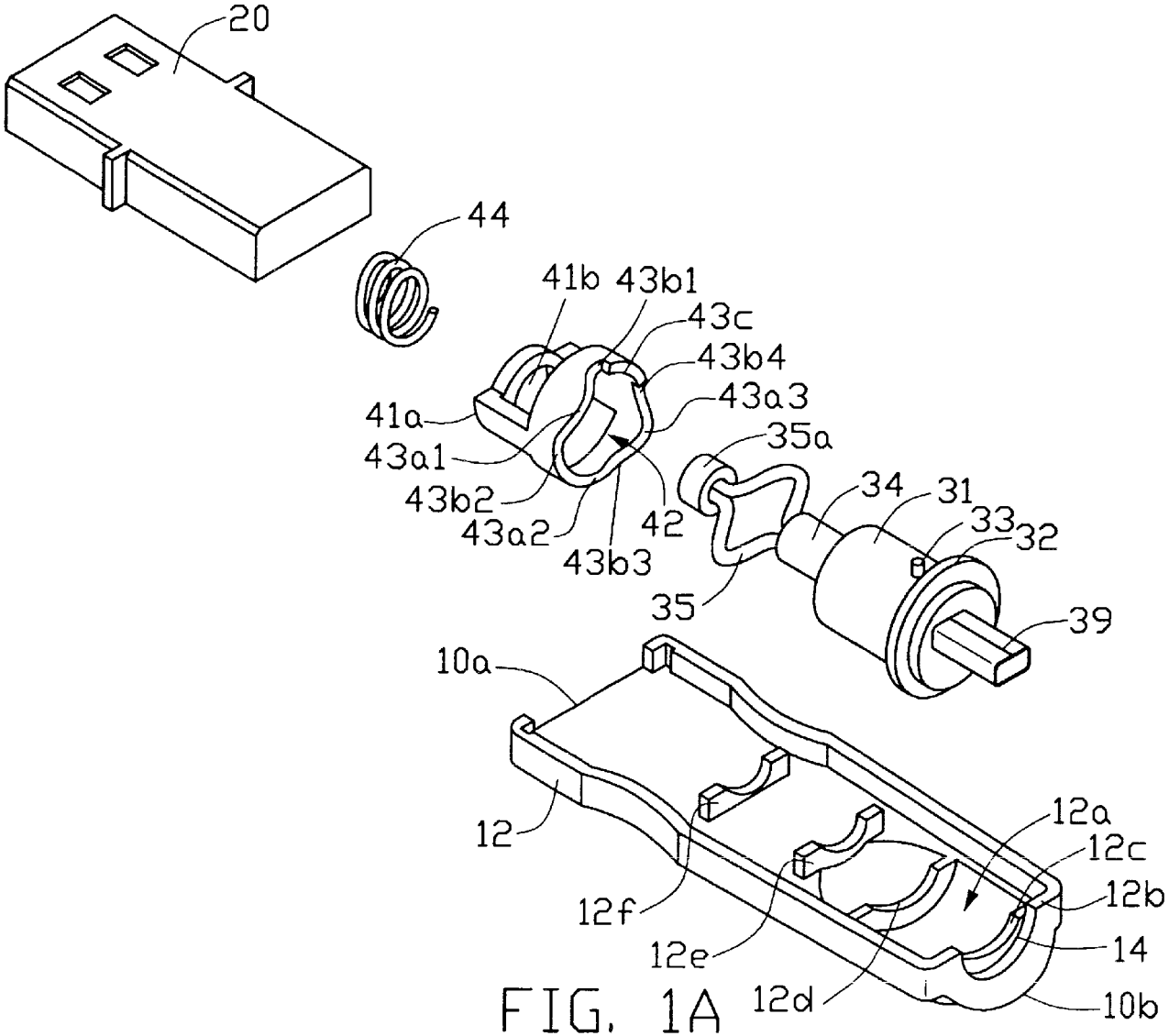
FIG. 1A is an exploded view of FIG. 1 viewed from a reverse angle.
Figure 2:
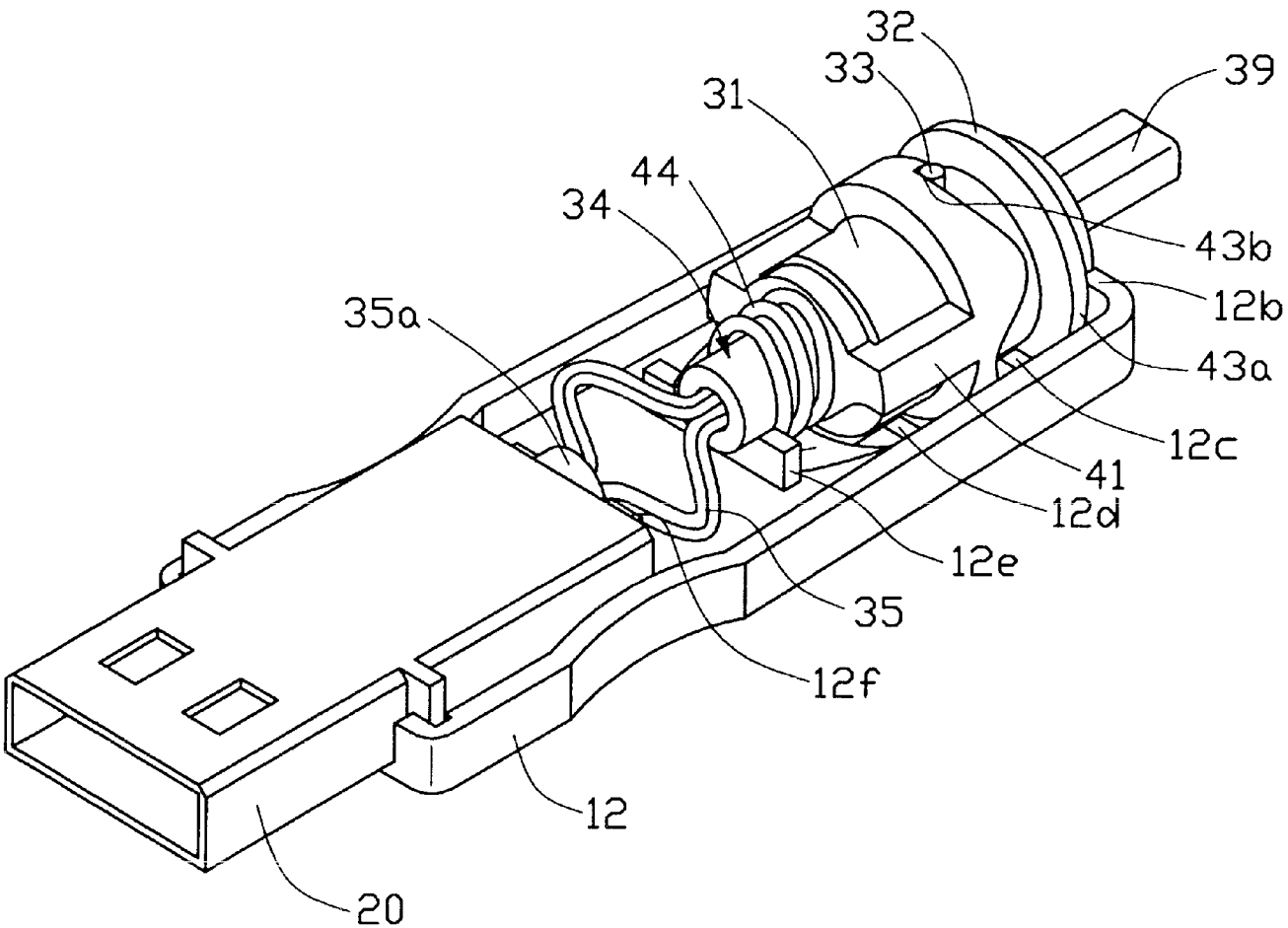
FIG. 2 is an assembled view of FIG. 1 with a upper half of a housing removed therefrom for illustration.
Figure 3:
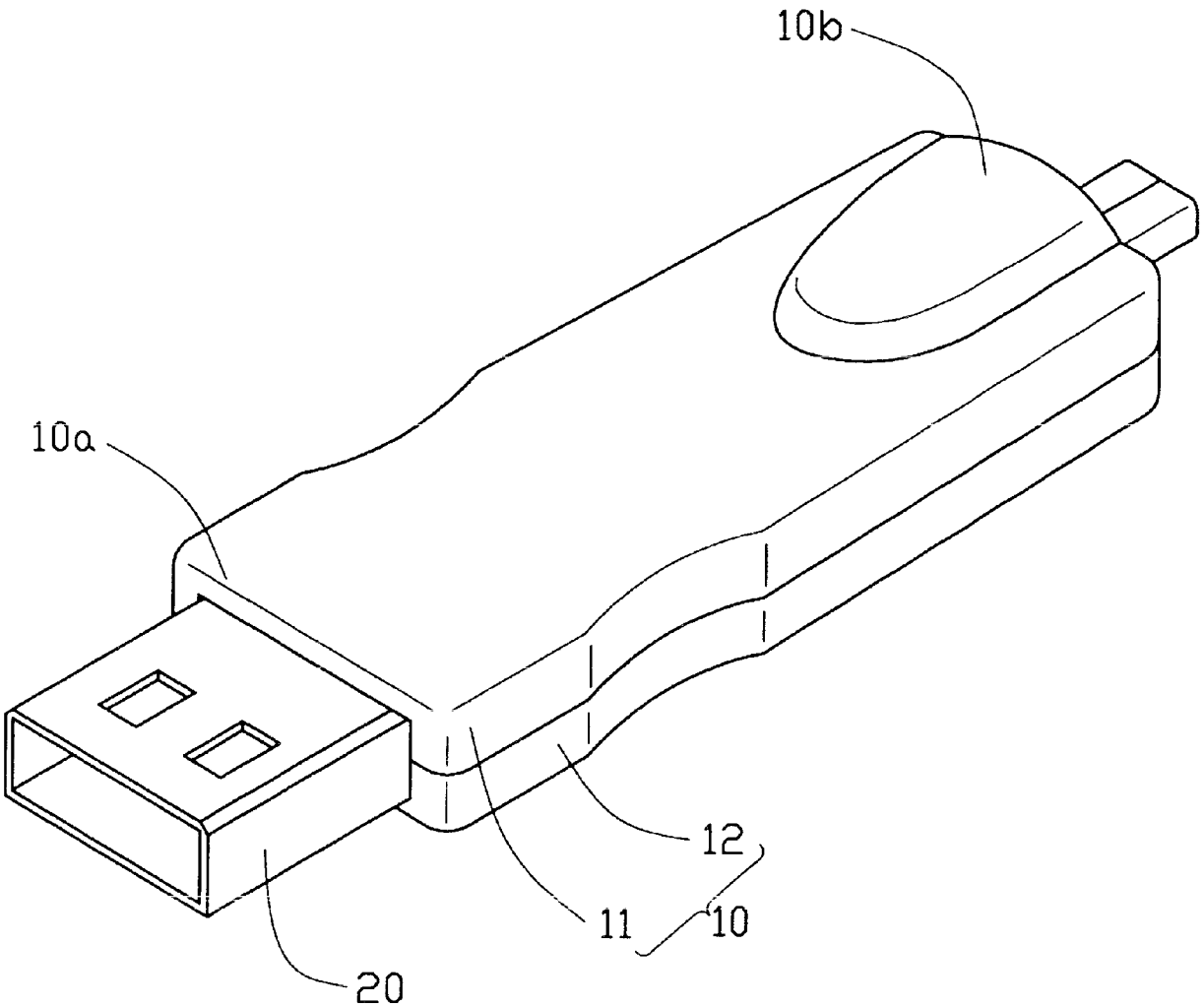
FIG. 3 is a assembled view of FIG. 2 with the upper half assembled thereto.

Still referring to FIG. 1A, the cam periphery 43 includes four valleys 43*b*1, 43*b*2, 43*b*3, 43*b*4 and three peaks 43*a*1, 43*a*2 and 43*a*3. A stop 43*c* is located between the valleys 43*b*1 and 43*b*4. As the second connector 30 includes the post

33 which can be securely disposed in the valleys 43*b*1, 43*b*2, 43*b*3, and 43*b*4, the antenna 50 attached thereto can be also arranged in different angle. According to the preferred embodiment, the valleys 43*b*1, 43*b*2, 43*b*3, and 43*b*4 are arranged in 0, 90, 180 and 270 degrees. As a result, the antenna 50 can be also arranged in these four positions.

In order to prevent the second connector 30 and its attached antenna 50 from rotating through 360 degrees, the stop 43*c* will effectively prevent the post 33 from passing therethrough. As a result, the second connector 30 and its attached antenna 50 can only be disposed in the selected position.

Figure 4A:
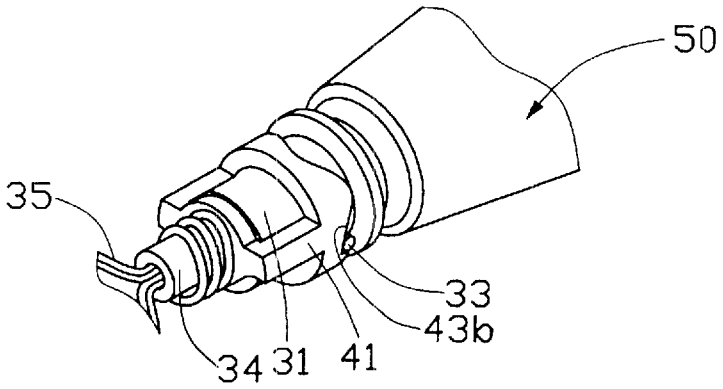
FIGS. 4A to 4C are consecutive views showing a second connector is rotated through 90 degrees with respect to a positioning device.
Figure 4B:
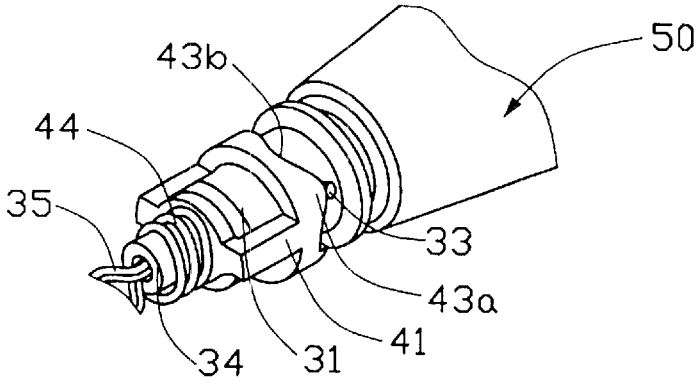
Figure 4C:
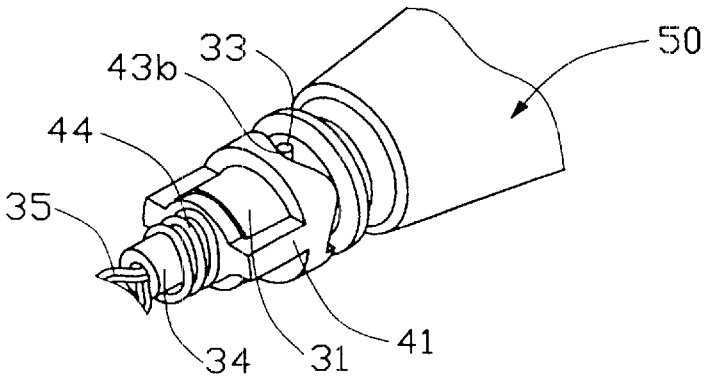

FIGS. 4A to 4C show how the second connector 30 is rotated with respect to the positioning device 40. In the normal condition, the post 33 rests on a valley 43*b*. When the second connector 30 is rotated, as the axial movement of the second connector 30 is limited by the arrangement between the ring 32 and the slot 14*a*, the post 33 will push the positioning device 40 downward, as shown in FIG. 4B. When the post 33 slides over the peak 43*a* and rests on another valley 43*b*, with the pushing force from the spring 44, the positioning device 40 moves back and keep the second connector 30 in the desired position.

Figure 5A:
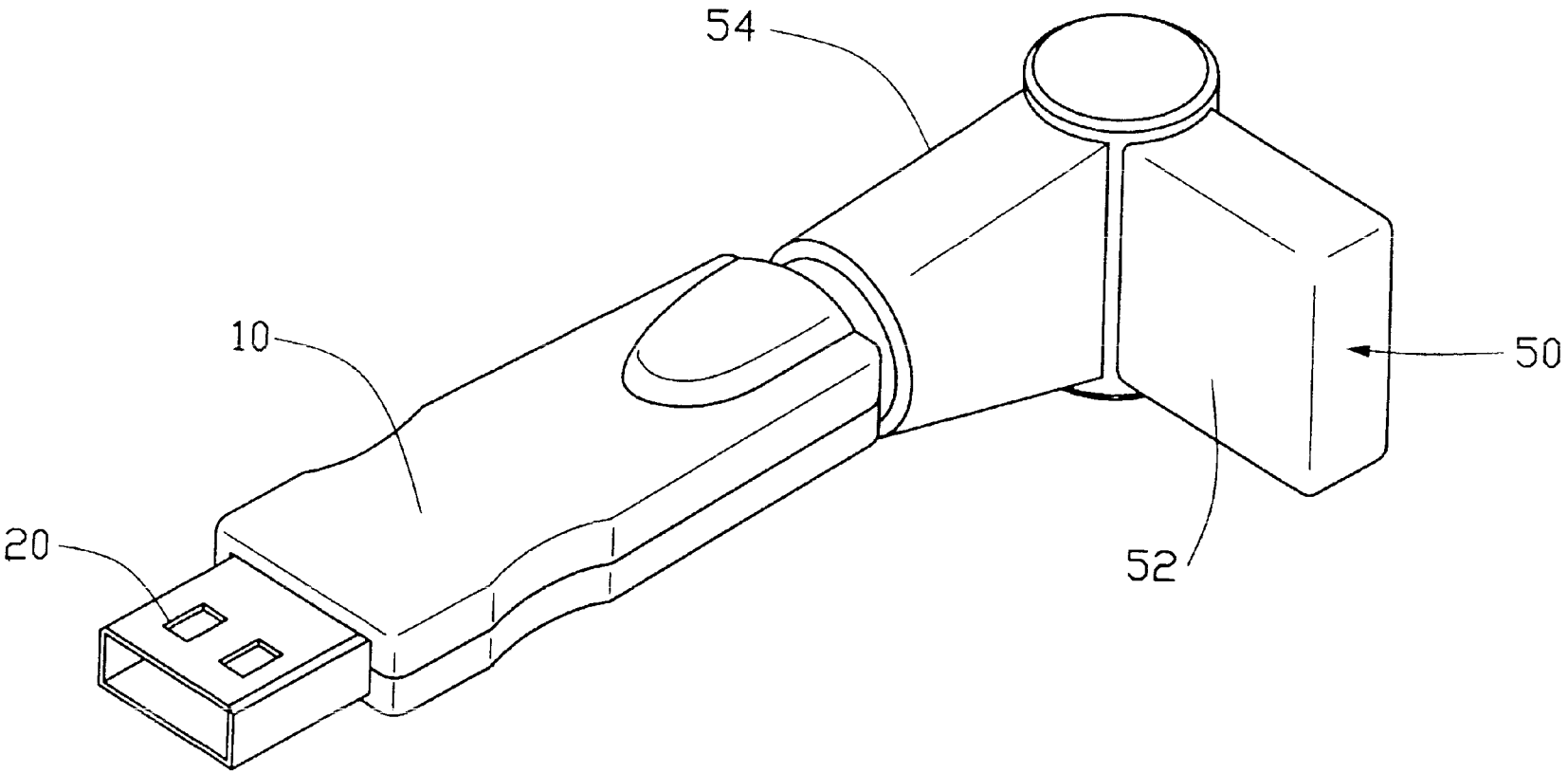
FIGS. 5A and 5B show the attached antenna disposed in vertical and horizontal position.
Figure 5B:
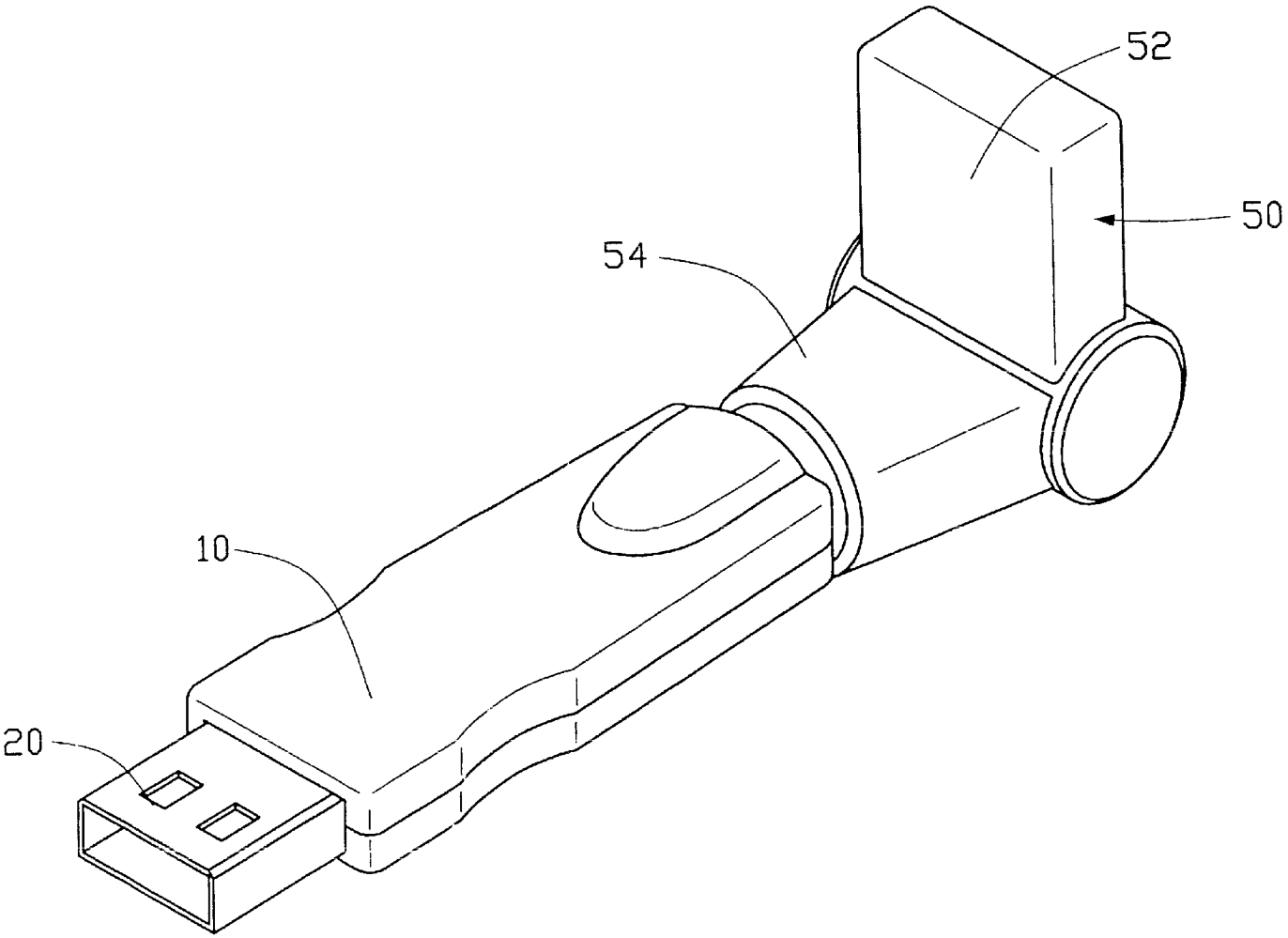

FIGS. 5A and 5B show how the antenna device 50 is rotated 90 degrees. It should be noted that the antenna device 50 includes a receiving section 52 and a connection section 54 perpendicular to each other, wherein the connection section 54 includes a connection port (not shown) for connecting to the connection port 39 of the second connector 30. Therefore, regardless of how the first connector 20 is connected with the corresponding mating connector on the panel of the computer, i.e., vertically or horizontally, the receiving section 52 of the antenna device 50 always can be adjusted to be in a vertical position in the space through rotating the second connector 30 with regard to the housing 10, thus assuring the best operation performance.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. An antenna adapter, comprising:

an elongate housing defining a receiving space therein and first and second ends opposite to each other;

a first connector fixedly positioned in the first end;

a second connector rotationally arranged in the second end and being electrically coupled to the first connector; and a positioning device arranged between the housing and the second connector such that the second connector can be angularly positioned with respect to the housing; wherein the positioning device includes a cylindrical body defining a chamber therein, the cylindrical body defining a body in a bottom thereof and forming a cam periphery at a top thereof.

2. The antenna adapter as recited in claim 1, wherein the second connector includes a tubular body rotationally received in the chamber of said positioning device, the tubular body further including a shaft extending through the hole defined in the bottom of said cylindrical body.

3. The antenna adapter as recited in claim 2, wherein a biasing spring is enveloped onto the shaft and abuts the cylindrical body toward the second connector.

4. The antenna adapter as recited in claim 1, wherein the second connector includes a post which anchors the second connector respect to the cam periphery of the cylindrical body.

5. The antenna adapter as recited in claim 1, wherein said second connector is rotated about an axis along a lengthwise direction of the housing.

6. An antenna assembly comprising:

an antenna device including a receiving section and a connection section in an angular relation with each other;

an adapter including a housing defining opposite first and second ends thereof;

first and second connectors respectively positioned at the first and second ends while electrically coupled to each other, said second connector connecting to the connection section of the antenna in a generally coplanar relation with each other; wherein one of said first connector and said second connector is rotatable with regard to the other, and the first connector is able to be in either perpendicular or parallel relation with the connection section of the antenna.

* * * * *